United States Patent [19]

Cary et al.

[11] 4,257,539

[45] Mar. 24, 1981

[54] UNIVERSAL BODY VARIABLE SHROUD DISPENSER

[75] Inventors: John R. Cary; Theodore J. Humphrey, II, both of Miami Lakes; Walter H. Wesner, Plantation, all of Fla.

[73] Assignee: The APA Corporation, Miami Lakes, Fla.

[21] Appl. No.: 93,465

[22] Filed: Nov. 13, 1979

Related U.S. Application Data

[63] Continuation of Ser. No. 881,998, Feb. 28, 1978, abandoned.

[51] Int. Cl.[3] ..... B67D 5/06

[52] U.S. Cl. ..... 222/182; 222/383; 239/288.5

[58] Field of Search ..... 239/288, 288.3, 288.5, 239/525, 526, 333; 222/23, 173, 182, 183, 383

[56] References Cited

U.S. PATENT DOCUMENTS

| | | | |
|---|---|---|---|
| 2,973,881 | 3/1961 | Ostrowitz | 222/182 |
| 3,236,421 | 2/1966 | Glazier | 222/182 |
| 3,820,721 | 6/1974 | Hellenkamp | 222/182 |
| 4,053,086 | 10/1977 | DeBard | 222/182 |
| 4,138,038 | 2/1979 | Grogan | 222/383 |
| 4,161,288 | 7/1979 | McKinney | 239/526 |

*Primary Examiner*—H. Grant Skaggs
*Attorney, Agent, or Firm*—Thomas W. Brennan

[57] ABSTRACT

A manufacture of fluid handling devices having a variety of different surface contours or appearances features a universal fluid handling component retaining body and a shroud for enclosing the universal body, the shroud being a selected one of a variety of shrouds that are fabricated separately from the body and that are characterized by having a common internal surface configuration for engaging in permanently affixed, or removable relation, predetermined, selected exterior portions of the universal body, and further, that are characterized by having different external or surface contours or appearances, the latter being determined by merchandising or consumer preference.

7 Claims, 9 Drawing Figures

UNIVERSAL BODY VARIABLE SHROUD DISPENSER

This is a continuation of application Ser. No. 881,998, filed Feb. 28, 1978 and now abandoned.

BACKGROUND OF THE INVENTION

1. Field of the Invention

The present invention relates to improvements in fluid handling devices, particularly for facilitating the manufacture of fluid handling devices having a variety of differently appearing exterior contours or surfaces and/or embodying external ornamental or other features tailored to individual merchandising or consumer preferences or requirements.

2. Description of the Prior Art

In the manufacture of fluid handling devices such as manually operable sprayers or dispensers the general practice has been to integrally mold, in a unitary assembly, the shroud or fairing with the component retaining body of the dispenser, as is disclosed, for example, in U.S. Pat. No. 3,061,202, granted on Oct. 30, 1962 to Tracy B. Tyler. Where it is desired to manufacture, in quantity, identically appearing dispensers, this is an effective cost reducing procedure. However, where it is desired to manufacture a variety of externally differently appearing dispensers, this procedure is undesirably expensive. This is because of the repetition in the molds for the unitary assemblies of the component retaining body as well as the shroud, the latter of which alone provides the desired dispenser differently appearing external feature.

Proposals in the prior art for providing different dispenser exterior contour or surface features have also included enveloping a complete dispenser including the shroud already provided in a further shroud that has been specifically designed to give the desired merchandising or consumer appeal. Such arrangements, however, unavoidably become bulkier than desired as well as undesirably expensive inasmuch as they entail the use and cost of an additional shroud and its attachment to the dispenser.

SUMMARY OF THE INVENTION

Among the objects of the present invention is the provision of a novel fluid handling device and shroud arrangement that avoids the above-mentioned problems of the prior art.

A further object of the present invention is to facilitate the manufacture of fluid handling devices, and in particular manually operable fluid dispensers, having a variety of different external surface contours or other distinguishing features.

Still another object of the present invention is to achieve these results while maintaining a desired size of the fluid handling devices or dispensers and at the same time effecting a desired reduction in the cost of manufacture thereof.

In accomplishing these and other objects there are provided according to the present invention fluid handling devices or dispensers having a variety of different external surface features comprising a universal fluid handling component retaining body means in skeletal form, said body means including inlet means, pump means, and outlet means, and a shroud for enclosing said body means, said shroud being a selected one of a variety of shrouds made separately from said body means, said variety of shrouds being characterized by their common internal surface means provided for engaging predetermined, selected, exterior portions of said body means upon placement thereof in cooperative enclosing relation with respect to said body means, and being further characterized by their different external surface features, the latter being determined by merchandising or consumer preference. In a specific aspect of the invention the internal surface means that is common to said variety of shrouds comprises a plurality of spaced elements or ridges that project in a predetermined pattern from the interior surface of each of said shrouds. This predetermined pattern is in accordance with the predetermined, selected portions of said body means to be engaged, and is identical for all of the shrouds. Thus, upon placement of any one of the shrouds in cooperative enclosing relationship with said universal body means, said plurality of spaced elements engage associated ones of said selected portions of said body means thereby to effect a predetermined, desired positioning of said shroud with respect to said body means, which positioning is substantially the same for all of the shrouds notwithstanding the differences in their external surface configuration or other features. The selected portions of the body means in this specific aspect of the invention desirably include exterior portions of the body means that are opposite to each other, for example, portions of the inlet and outlet means that are remote from each other, and other portions of the inlet means disposed transversely with respect to said first mentioned inlet portion. Another selected portion of the body means desirably is an upper surface or ridge on the outlet means which in a preferred embodiment of the invention is elongated.

In the preferred embodiment of the invention the shrouds are permanently affixed to the universal body means associated therewith as by ultrasonic welding or other suitable bonding means. It is to be understood, however, that if desired, a shroud need not be permanently attached to an associated universal body means but may be maintained in a readily separable relation therewith thereby enabling the substitution by the merchant or the consumer of one shroud for another from a variety of different shrouds thereby more easily to satisfy an individual preference or requirement.

BRIEF DESCRIPTION OF THE DRAWINGS

A better understanding of the present invention may be had from the following detailed description when read in connection with the accompanying drawings wherein.

DESCRIPTION OF THE PREFERRED EMBODIMENT

Figure 1:
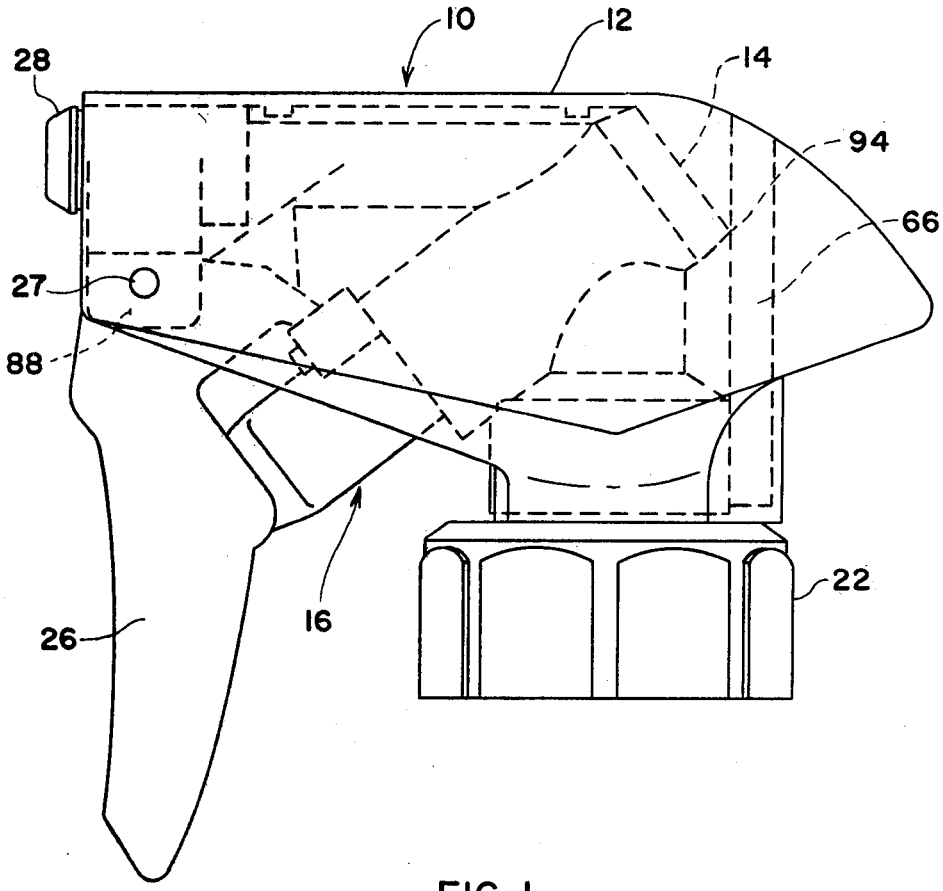
FIG. 1 is a side elevational view of a dispenser having a shroud and showing by dotted lines the engagement of predetermined selected portions of a universal component retaining body of the dispenser by internal surface means provided on the shroud.

FIG. 1 of the drawings shows a manually operable trigger sprayer or dispensing device 10 having a fairing or shroud 12 that is provided for aesthetic and other reasons as dictated by merchandising or customer preference.

Figure 2:
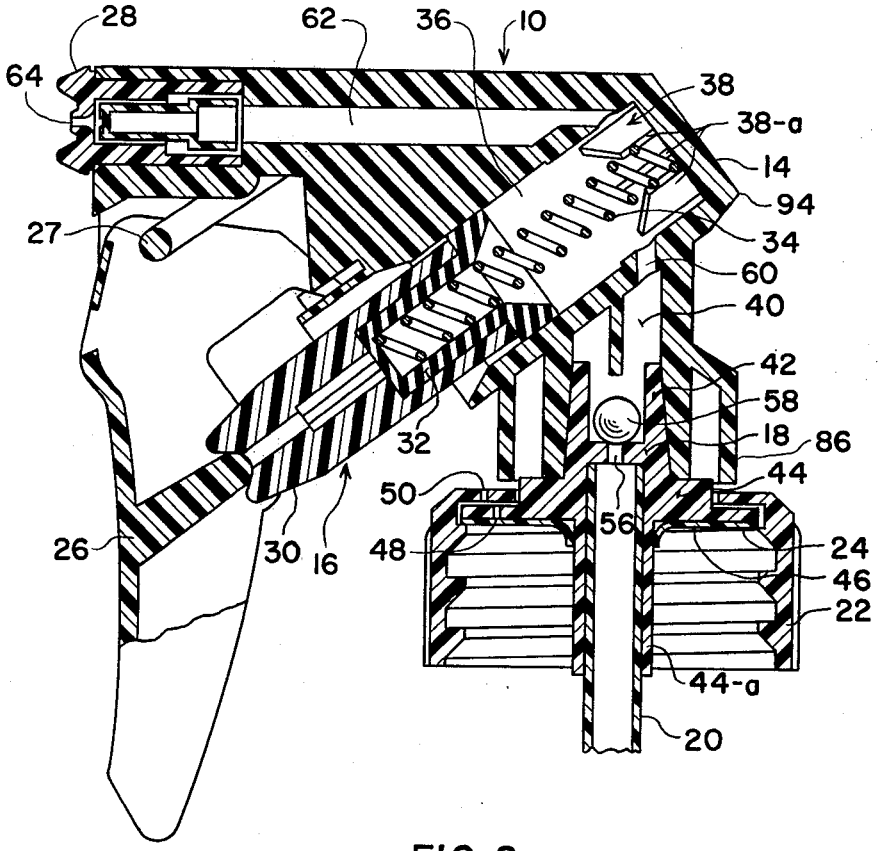
FIG. 2 is a vertical sectional view of the universal body of the dispenser of FIG. 1, taken along the lines 2—2 of FIG. 3.
Figure 3:
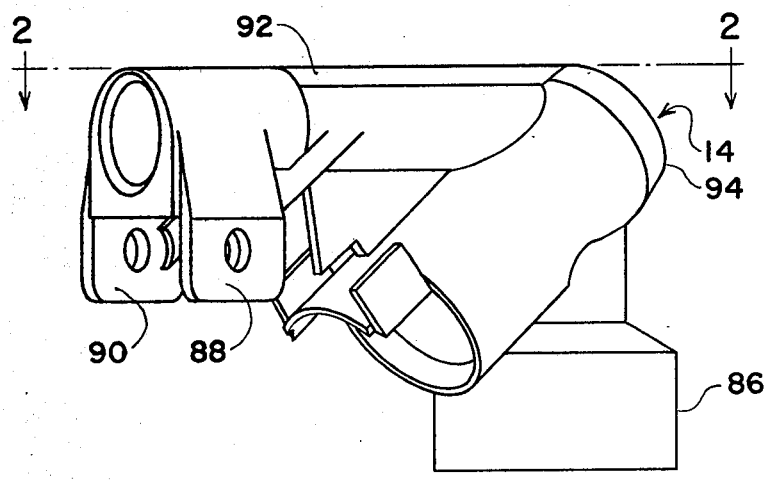
FIG. 3 is a perspective view, illustrating the skeleton outline form of the universal body of the dispenser of FIG. 1.
Figure 4:
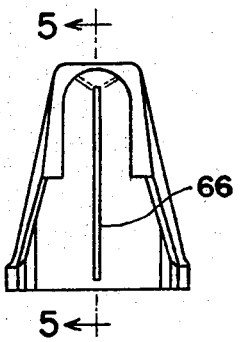
FIG. 4 is a front view of the shroud only of the FIG. 1 illustration.
Figure 5:
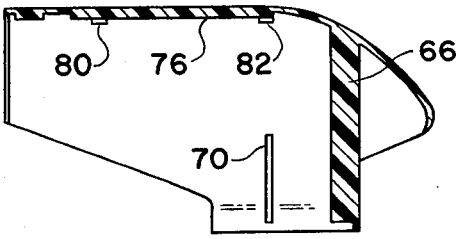
FIG. 5 is a vertical sectional view of the shroud taken along the lines 5—5 of FIG. 4.

The device 10 includes a basic or universal component retaining body 14 the outline of which is shown by dotted lines in FIG. 1 and in cross section in FIG. 2. The body 14 is further illustrated, in a perspective view, by FIG. 3.

The device 10, as shown in FIG. 2, includes a trigger lever actuated pump mechanism 16, an inlet or intake stem 18, a dip tube 20, a bottle cap 22, a seal 24, a trigger 26, supported on body 14 by a pin 27, and a nozzle 28. The bottle cap 22 threads on to the upper end of a container (not shown) of fluid product to be dispensed or sprayed.

The pump mechanism 16 and nozzle 28 may be of any of the known types available in the art, but for purposes of illustrating an operative embodiment of the present invention, they may be and have been shown as of the type disclosed in U.S. Pat. No. 3,685,739, Vance R. Vanier, granted Aug. 22, 1972. Thus, the pump mechanism, as shown in FIG. 2, includes a hollow piston 30 containing a rubber or flexible cup-shaped piston washer 32, and a piston reaction spring 34 mounted within a chamber or cylinder bore 36 formed in body 14. Piston 30 together with washer 32 acts as a two-piece piston.

One end of spring 34 is confined within a spring cage 38. Spring cage 38 is comprised of a plurality of circumferentially spaced, inwardly extending, radial fins 38-*a* that are formed integrally with body 14, in the wall of chamber or cylinder 36 adjacent the inner wall thereof. The other end of spring 34 seats within washer 32 which forms part of piston 30.

The body 14 is formed with a conical cavity 40 into which is pressed the upper conical end 42 of intake stem 18 thereby to securely fix the stem 18 to the body 14. A flange 44 on the lower end of stem 18 preferably abuts against the lower end of the wall of cavity 40. The dip tube 20 is press fit in intake stem 18. Dip tube 20 extends into the container previously mentioned but not shown and desirably extends to a position adjacent the bottom thereof. A circumferential flange 46 on seal 24 is compressed between the flange 44 and the top surface of the neck of the container so as to effect a tight seal therebetween.

A small vent opening 48 provided in flange 44 communicates with a vent opening 50 in the cap 22. Air is drawn into container from the atmosphere through these vent openings, past the inner circumferential edge of seal 24, during the suction stroke of the two-piece piston 30, 32. A check valve may be provided, if desired, to permit air to be drawn into the container through vent openings 50 and 48 but to prevent the reverse flow of air from the container. Such a check valve may take the form of conical seal 24 which acts as a check valve by sealing against a depending stem 44-*a* of flange 44. Thus, the seal 24 serves the dual function of a check valve and a washer for effecting a liquid tight seal between flange 44 and the outlet of the container.

Intake stem 18 is provided with an opening 56 adjacent the upper end of dip tube 20. Opening 56 is controlled by a ball check type valve 58 which allows liquid to be drawn upwardly through the dip tube 20 and opening 56 into the conical cavity 40 but prevents reverse flow of liquid from cavity 40 through opening 56 into the dip tube 20. Cavity 40 communicates through an opening 60 with the cylinder 36.

An outlet conduit 62 provides communication between cylinder 36 and nozzle 28. Nozzle 28 provides a combination check valve and spinner element as described in the previously mentioned Vanier patent, and hence, will not be further described herein except to note that liquid ejected from an orifice 64 therein may be in the form of a jet or solid stream or in the form of a spray or mist, as desired.

In the operation of the dispensing device 10, if trigger 26 is manually squeezed to force the two-part piston 30, 32 inwardly of cylinder 36, air therein is compressed to cause the inlet check valve 58 to seat and close opening 56 and to cause the outlet check valve of nozzle 28 to open thereby to expel a quantity of pressurized air to the atmosphere through orifice 64. Upon release of trigger 26, spring 34 biases piston 30, 32 outwardly of cylinder 36, thereby creating a sub-atmospheric pressure in cylinder 36. Repetition of this pumping action effects evacuation of the air from cylinder 36 and causes liquid to be drawn into cylinder 36 through dip tube 20 thereby to prime the pump mechanism with liquid. Further actuation of the trigger 26 to reciprocate piston 30, 32 causes liquid to be pumped in a jet or spray from the orifice 64 each time trigger 26 is squeezed.

The component retaining body 14 preferably is molded as a single member of rigid plastic, by any known process, with the various passageways and cavities formed during the molding process. Additionally, the several components retained by body 14 including the hollow piston 30, piston washer 32, trigger 26, intake stem 18 and cap 22 as well as the shroud 12 are preferably similarly molded as individual members. Plastics suitable for molding the body 14 and the several components are thermoplastic resins such as polypropylene, polyethylene, and polytetramethylene terephthalate (PTMT).

The molding or forming of shroud 12 of rigid plastic independently of the manufacture of body 14 is an important feature of the present invention, having the completely unobvious and synergistic effect of significantly reducing the manufacturing cost, and increasing efficiency in the production of dispensers that are tailored, in their external features, to individual merchandising or consumer preferences.

Figure 6:
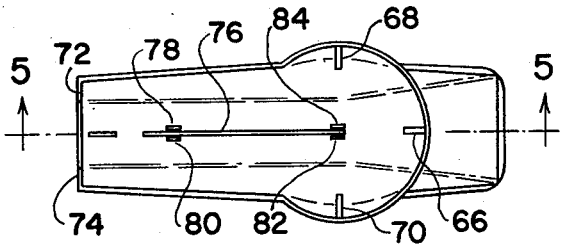
FIG. 6 is a bottom plan view of the shroud of FIGS. 1, 4 and 5.
Figure 7:
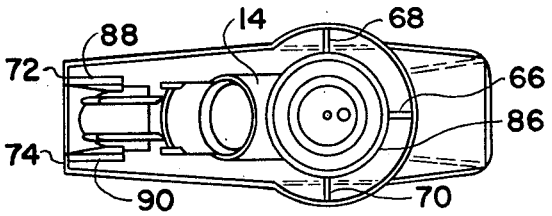
FIG. 7 is a view similar to that of FIG. 6, illustrating the manner in which the shroud encloses the dispenser of FIG. 1, the universal component retaining body only being shown for clarity of illustration; and, FIGS. 8 and 9 are perspective views of other shrouds, that may be employed with the dispenser of FIG. 1, such other shrouds having different external features.

Shroud 12 is in the form of a shell having generally uniformly thin flexible walls, as is indicated in FIGS. 6 and 7, and provides the external characteristics or features desired. The mold required for the formation of each shroud is relatively simple and inexpensive compared to the mold required for the component retaining body 14 which because of the many passages and cavities provided is quite complex and expensive. As a result, a variety of shrouds may be developed inexpensively to meet individual preferences or requirements.

In accordance with the present invention all such shrouds are further characterized by having a common internal configuration or an internal surface means that mates with the external configuration of the component retaining body means 14. That is to say, each of the several or variety of shrouds 12 is characterized by having a plurality of spaced projections or elements 66, 68, 70, 72, 74, 76, 78, 80, 82 and 84, as seen particularly in FIGS. 4–7, that project in a predetermined pattern from the interior surface thereof for engagement with predetermined, selected portions of the component retaining body 14.

As illustrated in FIG. 7, such predetermined selected portions of body 14 desirably include exterior portions of body 14 that are oppositely disposed. Thus, shroud element 66 is shown as in engagement with the surface of a cylindrical member 86 of body 14 that is concentric with intake stem 18, at a rearward position on member 86 in line with the outlet conduit 62 and furthest from the nozzle 28, and shroud elements 72 and 74 are shown as in frontal edge engagement with depending members 88 and 90, respectively provided on body 14 adjacent nozzle 28, to which members 88 and 90 trigger 26 is pivoted by pin 27. Further, shroud elements 68 and 70 engage opposite sides of cylindrical member 86, each at positions desirably spaced no more than 90° around the surface of member 86 from shroud element 66. Additionally, elongated shroud element 76 engages a ridge 92 provided on the upper surface of body 14 parallel to outlet conduit 62, and shroud element pairs 78, 80 and 82, 84 engage opposite sides of the ridge 92.

By virtue of this internal configuration any shroud 12 so made is adapted to enclose any component retaining body 14 in a predetermined manner. As seen particularly in FIG. 1, a rear edge 34 of body 14 also engages shroud element 66. The position of this engagement desirably is slightly over center whereby shroud 12 may be made to snap in placed when in enclosing relation with respect to body 14 thereby retaining the shroud 12 over body 14. Specifically, by reference to FIGS. 1 and 3, it is seen that with shroud 12 in cooperative enclosing relation with body 14, the lower or outer angle between the inner edge of shroud element 66, which is straight, and each of straight lines extending between edge 94 and depending members 88 and 90, respectively, of body 14, is slightly less than 90°. As the shroud 12 is lowered down over body 14, however, that outer angle is initially slightly greater than 90°, including the position of first contact of shroud element 66 with edge 94, shroud elements 72 and 74 meanwhile substantially simultaneously engaging depending members 90 and 88, respectively. Upon further such downward movement of shroud 12, the shroud element 66 passes through a position relative to edge 94 at which the said outer angle is precisely 90° following which the said outer angle is reduced to a value slightly less than 90°. This transition through a 90° position, termed an "over center" position, produces an action that is similar to a toggle action wherein, at the 90° position, the thrust forces exerted outwardly by body 14 on shroud 12 between the points of contact at element 66 and at elements 72 and 74 are greatest. Thus, as shroud 12 is moved donwardly over body 14 through the position at which the said outer angle is exactly 90°, the shroud 12 snaps in place and is retained in desired cooperative enclosing relation with body 14. This method of retaining the shroud 12 in enclosing relation with body 14 may be utilized if desired, thereby to facilitate ready substitution of one of a variety of shrouds for another. It is preferred, however, to fixedly attach the shroud 12 to the body 14 that it encloses as by the use of a suitable bonding means, for example, ultrasonic welding. Thus, vibration generated by an ultrasonic welding technique causes one or more of the shroud elements to fuse with the selected surface of body 14 with which it is engaged.

Figure 8:
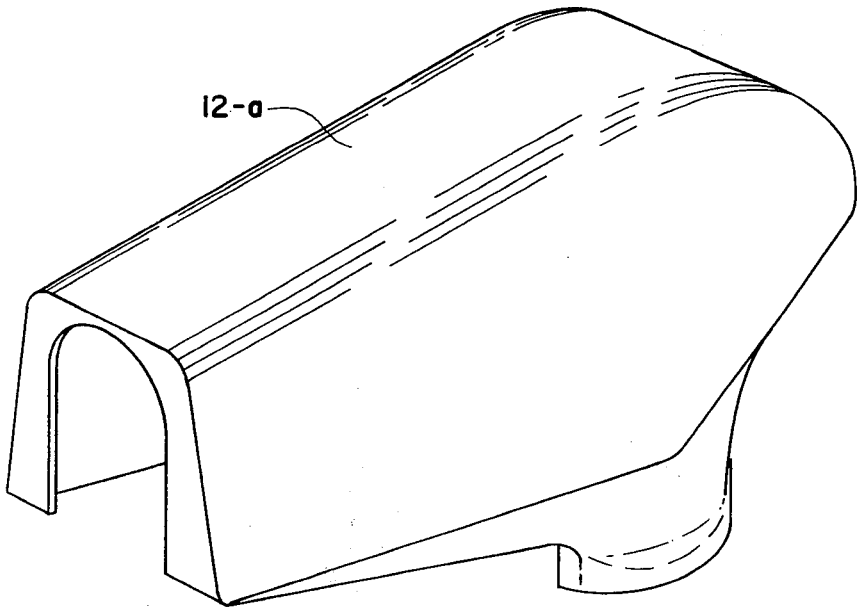
Figure 9:
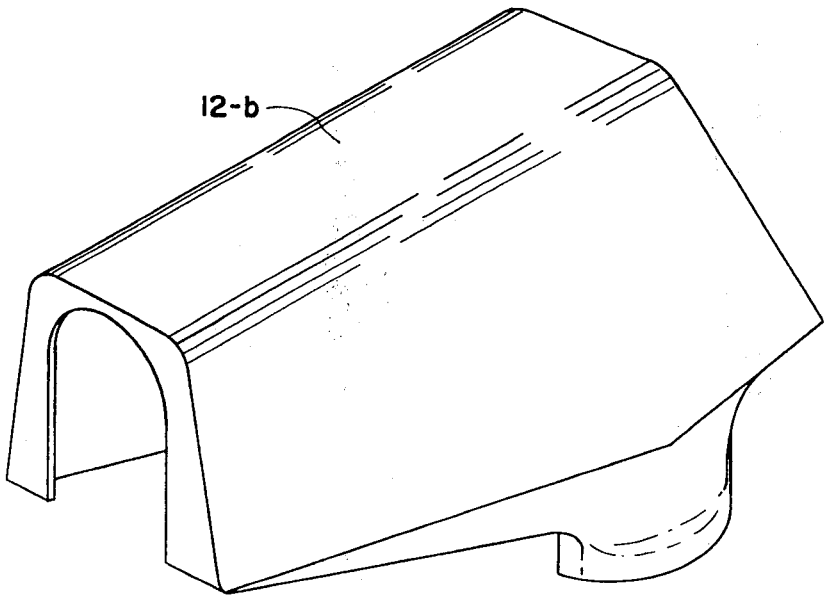

FIGS. 1 and 4 through 7 in addition to illustrating the internal configuration of the shroud 12, also illustrate the external appearance, contour or ornamental design that the shroud 12, in one aspect of the invention, may take. Other forms of shroud external appearance, contour or ornamental appearance are illustrated, by way of example only, in FIGS. 8 and 9. A variety of shrouds having other external characteristics or features may be devised appealing to the individual tastes of the merchandiser and/or consumer. Desirably, the internal configurations of such other shrouds and shrouds **12*a* and 12*b* of FIGS. 8 and 9, respectively, may be substantially identical, to that described for the shroud 12 of FIGS. 1 and 4–7**.

It should be understood, however, that the specific internal configuration for shroud 12 shown and described with reference to FIGS. 1 and 4–7 is not essential to the practice of the invention in its broader aspects and that other patterns of projections or elements on the internal surface of the shrouds may be made to mate with other predetermined selected portions of the associated component retaining body. What is essential is that the characteristic features of the component retaining body that is adopted as the body to be used universally with a variety of shrouds be such as to allow the development for all of the variety of shrouds to be developed of a predetermined pattern of internal projections or elements that mates with a pattern of predetermined portions of such body.

What is claimed is:

1. A manufacture of fluid handling devices having a variety of different external surface features comprising, a universal fluid handling component retaining body means including inlet means, trigger actuated pump chamber means, and outlet means, and a flexible thin shell shroud for enclosing said body means, said shroud being a selected one of a variety of shrouds made separately from said body means, said variety of shrouds being characterized by their common projecting internal surface means positioned to provide, in cooperation with said thin shell shroud, snap action engagement with predetermined selected portions of said body means upon placement thereof in cooperative enclosing relation with respect to said body means, and being further characterized by their different external surface features, wherein said inlet means, trigger actuated pump chamber means, and outlet means are each substantially enclosed on all sides except the bottom thereof by said shroud, wherein said common internal surface means of said variety of shrouds includes a plurality of spaced elements, wherein a selected portion of said body means includes an elongated cylindrical member associated with said outlet means, said cylindrical member having an elongated surface ridge, at least one of said spaced plurality of elements engaging said ridge, and wherein said one of said plurality of spaced elements is elongated and said elongated surface ridge and said one of said elements are in engagement for a substantial portion of the length of said ridge.

2. A manufacture as specified in claim 1 wherein said elongated surface ridge is further engaged on opposite sides thereof by at least two others of said plurality of spaced elements.

3. A manufacture as specified in claim 1 wherein the end of said outlet cylindrical member is engaged by at least one other of said plurality of spaced elements, and wherein another selected portion of said body means includes a cylindrical member associated with said inlet means, said inlet cylindrical member being engaged by at least another one of said plurality of spaced elements at a position on the periphery thereof remote from said outlet means.

4. A manufacture as specified in claim 3 wherein the periphery of said inlet cylindrical member is engaged by said another one of said plurality of spaced elements at a position substantially coplanar with the axis of said outlet elongated cylindrical member, and wherein the periphery of said inlet cylindrical member is further engaged by two others of said plurality of spaced elements, one of said two others of said elements on each side of said another one of said elements and spaced no more than 90° therefrom around the periphery of said inlet cylindrical member.

5. A manufacture of fluid handling devices having a variety of different external surface features comprising, a universal fluid handling component retaining body means, said body means including inlet means, trigger actuated pump chamber means, and outlet means, and a flexible thin shell shroud for enclosing said body means, said shroud being a selected one of a variety of shrouds made separately from said body means, said variety of shrouds being characterized by their common projecting internal surface means positioned to provide, in cooperation with said thin shell shroud, snap action engagement with predetermined selected portions of said body means upon placement thereof in cooperative enclosing relation with respect to said body means, said common projecting internal surface means of said variety of shrouds including a plurality of spaced elements, said variety of shrouds being further characterized by their different external surface features, one of said selected portions of said body means including a cylindrical member associated with said inlet means, said inlet cylindrical member being engaged at its periphery by at least one of said plurality of spaced elements, another of said selected portions of said body means including a cylindrical member associated with said outlet means, one end of each of said inlet and outlet cylindrical members having a connection to said pump chanber means, said outlet cylindrical member being engaged at its end remote from said pump chamber means by at least another one of said plurality of spaced elements, a further one of said selected portions of said body means including a cylindrical member associated with said pump chamber means, said pump chamber cylindrical member extending at an angle of approximately 45° between said inlet and outlet cylindrical members, the axes of said inlet, outlet and pump chamber cylindrical members being positioned in a common plane, said one of said plurality of spaced elements providing a straight edge positioned substantially in said common plane, and an edge of said pump chamber cylindrical member remote from said outlet cylindrical member engaging said straight edge of said one of said plurality of spaced elements at a position thereagainst at which there is an angle of less than 90° between the outer portion of said straight edge of said one element and a straight line extending substantially in said common plane between said edge of said pump chamber cylindrical member and said one other of said plurality of spaced elements whereby said shroud is retained in cooperative enclosing relation in an over center manner with respect to said component retaining body means.

6. A manufacture as specified in claim 5 wherein the periphery of said inlet cylindrical member is engaged by at least three of said plurality of spaced elements, one of said spaced elements engaging the periphery of said inlet cylindrical member at a position remote from said outlet cylindrical member and substantially coplanar with the axis of said outlet cylindrical member, the other two of said spaced elements engaging said periphery one on each side of said one of said elements and spaced no more than 90° therefrom around said periphery.

7. A manufacture as specified in claim 6 wherein said elements are so dimensioned and spaced as to permit variation in the external shape of said shroud, the spacing and positioning of the inlet cylindrical member engaging portions of said three elements with respect to each other and with respect to the engaging portion of said element engaging the end of said outlet cylindrical member remaining the same for all different shroud external configurations.

* * * * *

UNITED STATES PATENT OFFICE

CERTIFICATE OF CORRECTION

Patent No. 4257539 Dated March 24, 1981

Inventor(s) John R. Cary, Theodore J. Humphrey, Walter H. Wesner

It is certified that error appears in the above-identified patent and that said Letters Patent are hereby corrected as shown below:

Title page, "The APA Corporation" should read -- The AFA Corporation --;

Column 5, line 36, delete "placed when" and insert -- place when placed --;

Column 5, line 60, "donwardly" should read -- downwardly --.

Signed and Sealed this

Sixth Day of October 1981

[SEAL]

Attest:

GERALD J. MOSSINGHOFF

Attesting Officer

Commissioner of Patents and Trademarks